United States Patent [19]

Horiuchi et al.

[11] 3,951,578

[45] Apr. 20, 1976

[54] APPARATUS FOR AUTOMATICALLY ADJUSTING CENTER-HEIGHT OF A MOLD AND THE LIKE USED FOR MANUFACTURING CONCRETE PIPES

[75] Inventors: Yoshiaki Horiuchi; Masaaki Hanawa, both of Kashiwa; Shinzo Hasegawa, Yokohama, all of Japan

[73] Assignee: Nippon Concrete Industries Co. Ltd., Tokyo, Japan

[22] Filed: June 28, 1974

[21] Appl. No.: 484,091

[52] U.S. Cl. ..... 425/150; 269/309; 425/454

[51] Int. Cl.[2] ..... B28B 17/00

[58] Field of Search ..... 425/150, 435, 453, 454; 249/144, 139, 177; 269/45, 309

[56] References Cited

UNITED STATES PATENTS

| | | | |
|---|---|---|---|
| 2,441,925 | 5/1948 | Wege | 269/25 |
| 3,355,993 | 12/1967 | Williamson | 425/150 |

FOREIGN PATENTS OR APPLICATIONS

| | | | |
|---|---|---|---|
| 1,140,795 | 8/1957 | France | 425/435 |
| 1,345,687 | 11/1963 | France | 425/435 |

*Primary Examiner*—Francis S. Husar
*Assistant Examiner*—Carl Rowold
*Attorney, Agent, or Firm*—Fidelman, Wolffe & Waldron

[57] ABSTRACT

This invention relates to an apparatus for automatically adjusting the center-height of a mold and the like which are used for manufacturing concrete pipes characterized in comprising a supporting device which supports a mold and the like for manufacturing concrete pipes horizontally in the manner that the center of the axis of the mold moves vertically along a perpendicular line and stops it at a determined position, and a detecting device which detects the position of the mold by contacting with the outside of it and controls and stops the movement of the said supporting device when the center of the mold is placed at the determined position.

5 Claims, 8 Drawing Figures

FIG. 1
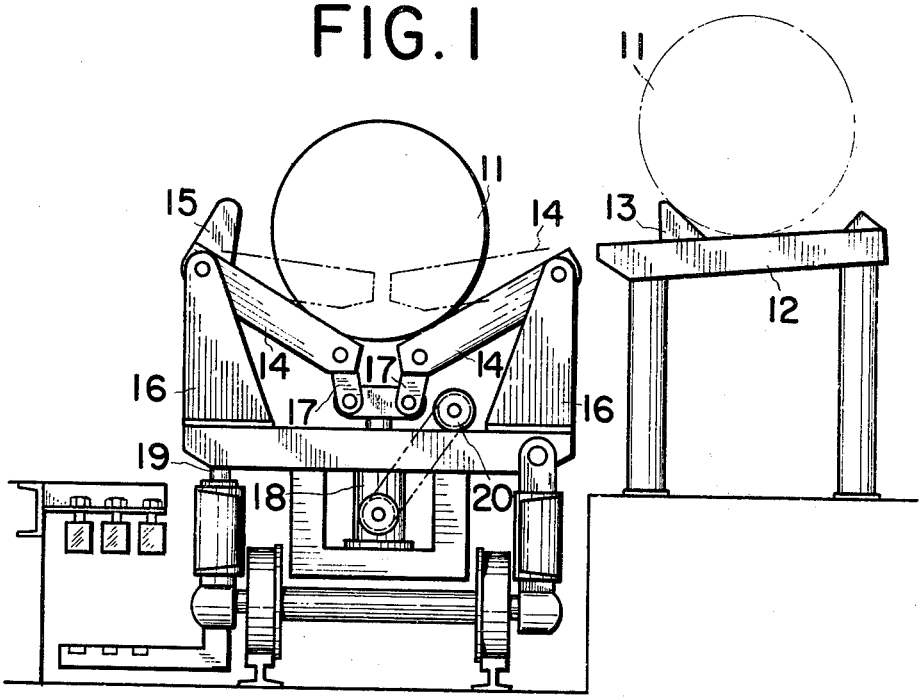
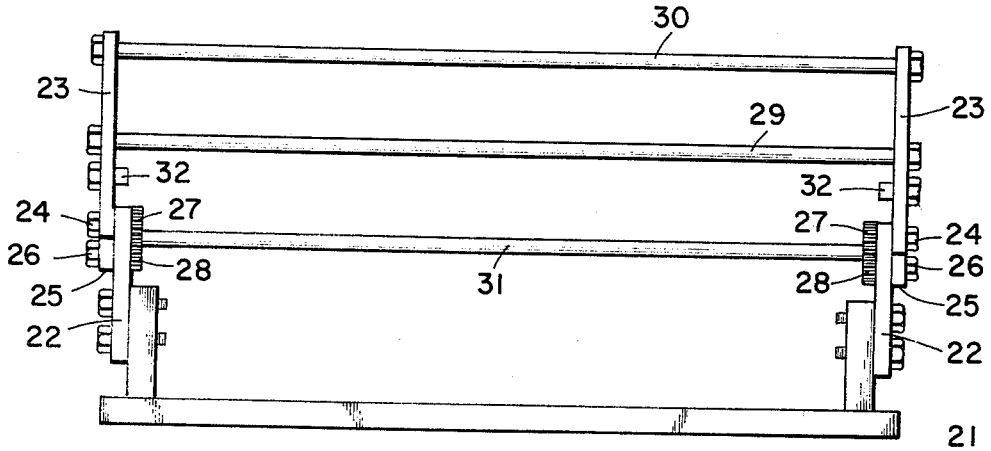
FIG. 7

A
11
30
P
O
29
33
P'
23
32
27
25
31
24
O'
26
28
22
A
21

(A)

(B)

APPARATUS FOR AUTOMATICALLY ADJUSTING CENTER-HEIGHT OF A MOLD AND THE LIKE USED FOR MANUFACTURING CONCRETE PIPES

SUMMARY OF THE INVENTION

This invention relates to an apparatus for automatically adjusting the center-height of a mold and the like used for manufacturing concrete pipes.

Presently, in case of manufacturing concrete pipes, there is a process, previous to the work of centrifugal compaction, that an injection truck on which a mold with an iron cage previously inserted is placed moves relatively to a concrete injection pipe and concrete is injected inside the said mold from the concrete injection pipe.

In order to enforce this process, it is necessary that the center-height of the concrete injection pipe is always the same as that of the mold. Further since it is hard to move the concrete injection pipe vertically for reasons of arrangements, the position of the mold should be regulated. However outer diameter of the mold is different according to the dimension of each concrete pipe to be manufactured. Therefore it is difficult on the work depending on eye-measurement of workers that the center-heights of various molds which outer diameters are different are regulated to be always the same as that of the concrete injection pipe, and further imprecise result can not be avoided.

The object of the invention is to provide an apparatus for correctly and automatically adjusting the center-height of the said mold for rapid manufacture of concrete pipes and the like and development of automatic manufacturing method.

In the invention, in order to attain the above object, in case of putting a mold on an injection truck, a supporting device which supports the mold horizontally in the manner that the center of the mold moves vertically along a perpendicular line and stops it at a determined position is used and a detecting device which detects the position of the mold by contacting with the outside of the mold and gives a stop-signal to the said supporting device at the time the center of the mold is placed at the determined position is provided.

Other objects and features of the present invention will be clear by a few embodiments of the invention described later according to the accompanying drawings.

BRIEF DESCRIPTION OF THE DRAWINGS

Drawings show three embodiments of the invention;

FIG. 1 is a front elevation view showing one example of a mold supporting device and an injection truck;

FIG. 4 is a view showing the principle;

FIG. 5 is an explanatory view showing the principle of a main part;

FIGS. 6 (A) and 6 (B) are partially sectional front elevation views of the detecting device at the time of detecting and FIG. 7 is a side elevation of FIG. 2.

DETAILED DESCRIPTION OF THE INVENTION

Figure 2:
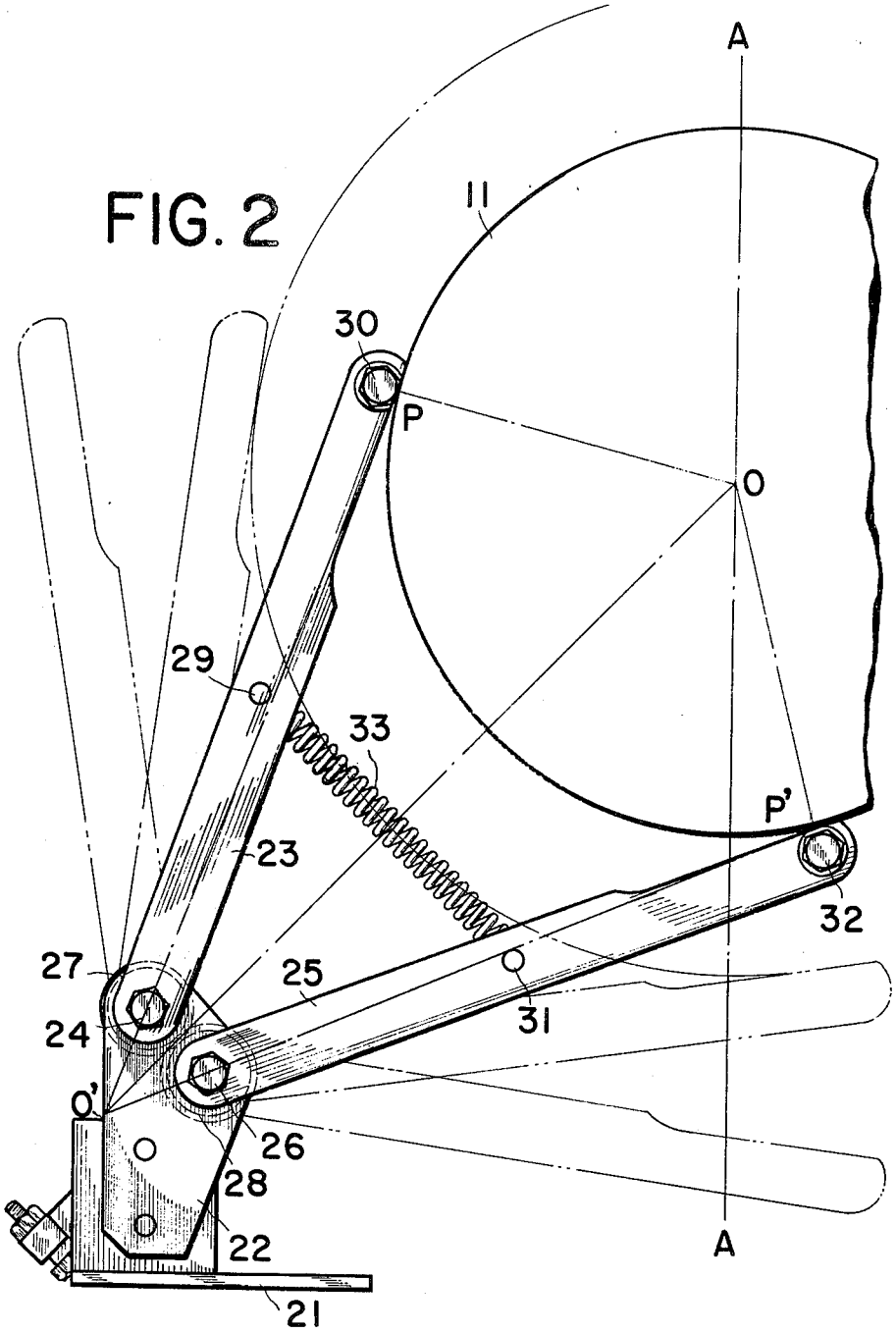
FIG. 2 is a partial enlarged front elevation view showing a center-height detecting device in the first embodiment of the invention.

In FIGS. 1 and 2 showing the first embodiment of the invention, first a mold 11 is put on an inclined stand 12 stopping the rolling movement of the mold 11 by a stopper 13 and after that the stopper 13 is removed and the mold 11 rolls onto a supporting V-block 14 shown with a two-dotted line in FIG. 1. Since another stopper 15 is provided at the opposite side of the supporting V-block 14 to prevent the drop of the mold 11, the mold 11 turns back to be placed on the center of the V-block 14. The V-block 14 is fixed to attaching plates 16 of an injection truck at both the outer ends in the freely swingable manner, and both the inner ends of the V-block 14 are supported by or connected with a top of a screw-jack 18 through links 17 and 17 which are connected with each other. When the mold 11 rolls onto the supporting V-block 14, a motor 20 is started by a load cell 19 which perceives the load of the mold 11 to lower the said screw-jack 18 so as to lower the mold 11 to the determined position shown with a solid line along a perpendicular line passing through the center of the axis of the mold 11. After that the motor 20 is stopped by a signal issued from a center-height detecting device which will be described later to hold the mold 11 there. The said supporting V-blocks 14 are provided at both ends and at one place or more in the middle part of the mold 11. The mold 11 is put on an injection truck through this supporting device. In case of a shortest mold, it is enough to provide the V-blocks only at the both ends of the mold 11. In the middle part where the said supporting V-blocks 14 are provided, various systems of center-height detecting device is provided.

FIG. 2 and FIG. 7 shows the first embodiment of the center-height detecting device of the invention. Two attaching plates 22 and 22 are arranged aligning with each other on a fixed base 21 on an injection truck. On the attaching plates 22 and 22, axes 24 and 24 to respectively fix detecting levers 23 and 23 and axes 26 and 26 to respectively fix receiving levers 25 and 25 are supported in the freely rotatable manner. The said axes 24 and 26 are close to each other and gears 27 and 28 of same diameter and same pitch which are respectively fixed to the axes 24 and 26 are provided engaging with each other. The detecting lever 23 and the receiving lever 25 are same in length, and the detecting levers 23 and 23 are constructed as one body by providing a connecting rod 29 at the middle and a rod 30 at the forward end between them. The receiving levers 25 and 25 are also constructed as one body by providing a connecting rod 31 at the middle between them and a switch 32 is provided at the forward end of the lever 25. Further a spring 33 is provided between the said connecting rods 29 and 31.

In the said center-height detecting device, when the mold 11 is lowered along a perpendicular line A—A being supported by the supporting V-blocks 14 as described before, the rod 30 contacts with the mold 11 and is pushed, and thereby the detecting lever 23 and the receiving lever 25 which have been opened at a certain angle facing each other are further pushed open respectively at same angle against the spring 33, and finally the bottom of the mold 11 contacts with the switch 32 of the receiving lever 25 as shown with a solid line in FIG. 2. Since the switch 32 is connected with a closing circuit of the motor 20, simultaneously the motor 20 is stopped to stop the supporting V-block 14, and thereby the mold 11 is stopped.

At the time of the said movement, the center of the mold 11 put on the supporting V-block 14 moves along a perpendicular line A—A, however in the condition that the bottom of the mold 11 is in contact with the switch 32, since triangles OPO′ and OP′O′ are congruent which are formed by a point O which is previously set on the line A—A, i.e. the center-height of a concrete injection pipe not shown in the drawing, respective contacts P and P′ of the mold 11 and the detecting lever 23 and the receiving lever 25, and an intersecting point O′ of the line of P and the center of the axis 24 and the line of P′ and the center of the axis 26, the center of the mold 11 always stops at a determined position O relating to respective switch operating points (to be set according to each diameter) according to the size of the mold 11.

Figure 3:
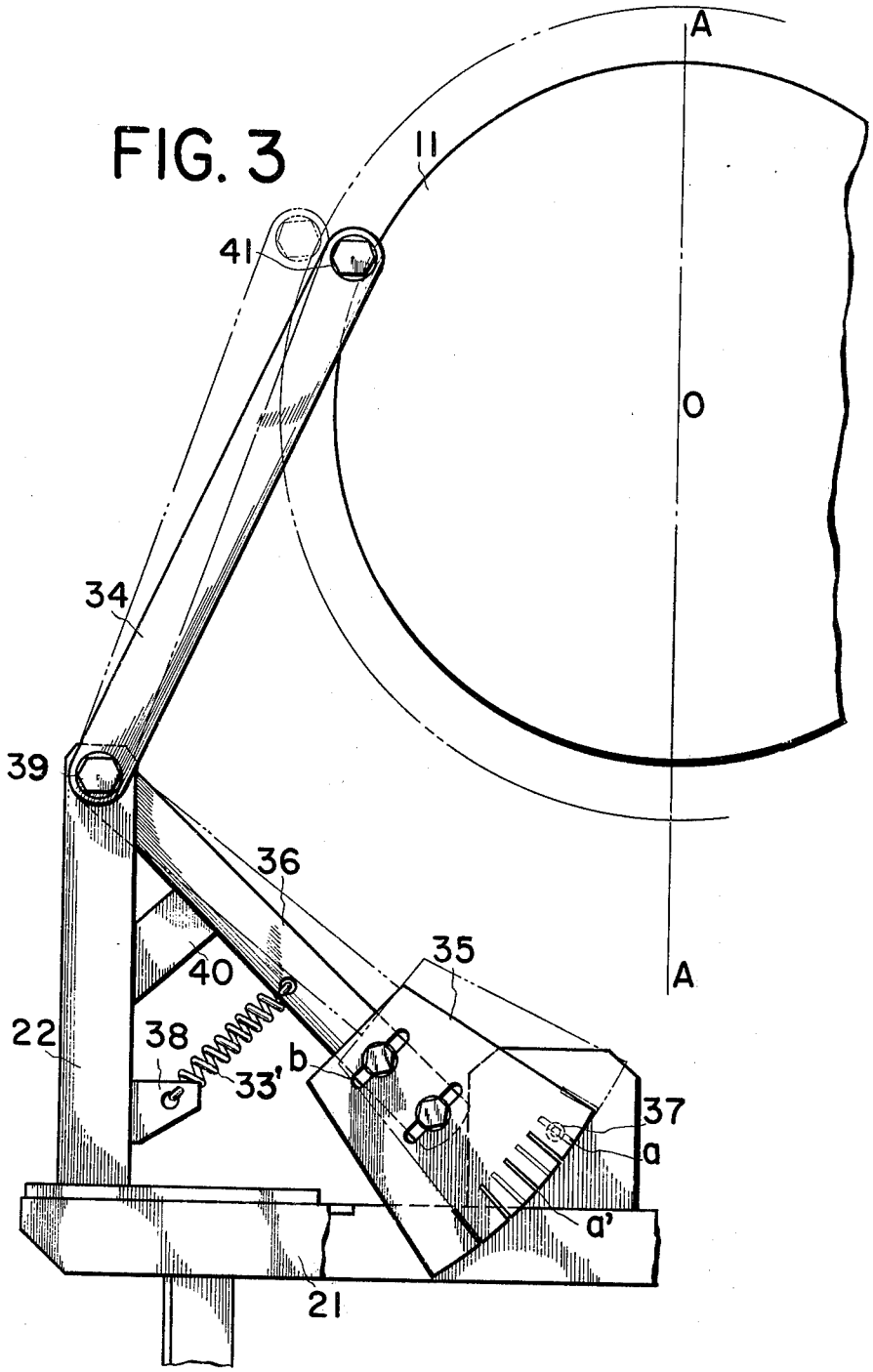
FIG. 3 is a partial enlarged front elevation view showing a center-height detecting device in the second embodiment of the invention.

FIG. 3 shows the second embodiment of the center-height detecting device of the invention. An attaching plate 22 is provided on a fixed base 21 on an injection truck and an axis 39 is provided at the top of the attaching plate 22 in the freely rotatable manner. At both ends of the axis 39 detecting levers 34 and 34 are fixed, and at the middle of the axis 39 a connecting lever 36 is fixed. A detecting plate 35 is fixed at the forward end of the connecting lever 36 in the freely adjustable manner through long holes *b*. The detecting plate 35 has suitable numbers of slits *a* according to predetermined numbers of various sizes of molds at a determined position. A light emitting part and a light receiving part of a phototube 37 are provided on the fixed base 21 at the front and rear parts of the detecting plate 35 so as to pass the light through the slit *a*. A spring 33′ is provided between a part of the connecting lever 36 and a projected piece 38 of the attaching plate 22, and the attaching plate 22 has also a stopper 40 to contact with the connecting lever 36.

In the center-height detecting device shown in FIG. 3, since when the mold 11 rolls onto the supporting V-blocks 14 and is lowered along the perpendicular line A—A passing through the center of the axis of the mold 11, a rod 41 which is provided between each forward end of the detecting levers 34 and 34 contacts with the side of the mold 11 as described before, the detecting levers 34 and 34 are moved so as to move the connecting lever 36 through the axis 39, and thereby the detecting plate 35 swings around the axis 39. When the slit *a* is placed at the center of the phototube 37, the phototube 37 is worked to stop the mold 11 at the determined position O for the concrete injection. The slits a of the detecting plate 35 are cut relating to the pressure welding rod 41 provided at the forward end of the detecting lever 34, and even if some difference is caused, the adjustment is possible by the long holes *b*. In case the outer diameters of cylinders of the mold 11 and the like are considerably different, other slits *a′* may be provided to indicate the center of the different diameter, so that the center of various sizes of molds 11 can be stopped always at the determined position O.

Figure 4:
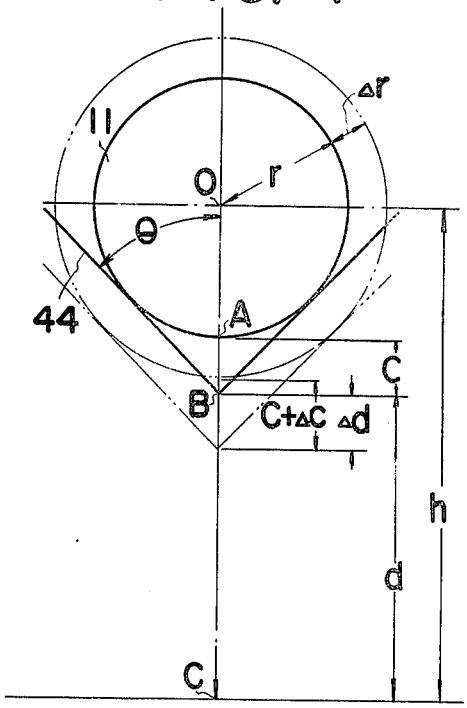
FIGS. 4 to 6 show a center-height detecting device in the third embodiment of the invention.
Figure 5:
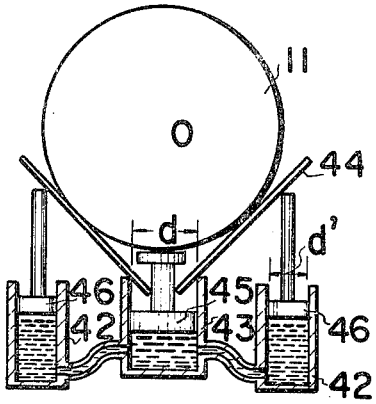
Figure 6:
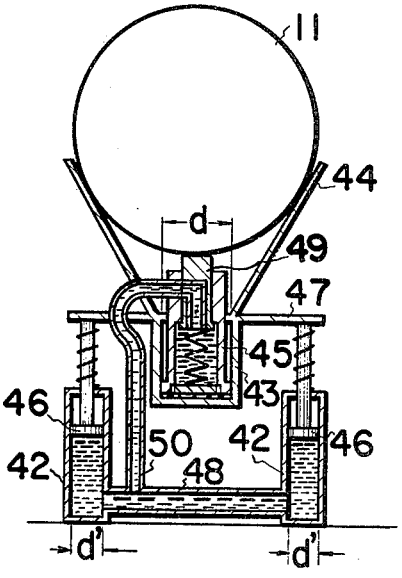
Figure 6:
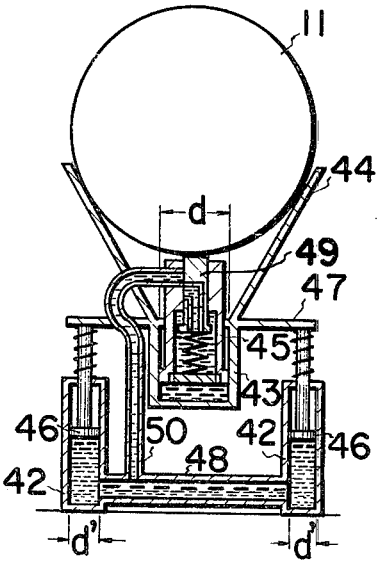

FIGS. 4 to 6 show the third embodiment of the center-height detecting device of the invention. In FIGS. 4 and 5, a load receiving cylinder 43 which is fixed to a V-shape supporting plate 44 and has a load receiving piston 45 to move vertically inside it so as to be able to contact with the mold 11 and balanced cylinders 42 and 42 which have suitable numbers of balanced pistons 46 and 46 to move vertically at a certain ratio to the load receiving piston 45 are provided. The V-shape supporting plate 44 is put on the balanced pistons 46 and 46 and fixed there placing the mold 11 at the center, so that the center of the mold 11 is automatically positioned at the predetermined position O.

In the abovementioned structure,

*r:* a radius of the mold 11, $2\theta$: an opening angle of the V-shape supporting plate 44,

*h:* a height of the center O,

*c:* a length of $\overline{AB}$, and

*d:* a length of $\overline{BC}$.

Therefore $$c = \overline{OB} - \overline{OA} = r\left(\frac{1}{\sin\theta} - 1\right), \text{ and}$$

$$d = \overline{OC} - \overline{OB} = h - \frac{r}{\sin\theta}.$$

Accordingly in the case of $r \rightarrow r + \Delta r$, if $\theta$ is constant, $$\Delta c = \Delta r\left(\frac{1}{\sin\theta} - 1\right), \text{ and}$$

$$\Delta d = h - \frac{\Delta r}{\sin\theta}.$$

Assuming that the volume and the area of the cylinders 43 and 42 are respectively V and V′ and A and A′, the change in the volume of each cylinder is $$\Delta V = A\,\Delta r\left(\frac{1}{\sin\theta} - 1\right), \text{ and}$$

$$\Delta V' = -\frac{A'\Delta r}{\sin\theta}.$$

Therefore, since $\Delta V + 2\Delta V' = 0$, there are some relations as in the following, $$A\Delta r\left(\frac{1}{\sin\theta} - 1\right) - \frac{2A'\Delta r}{\sin\theta} = O,$$

$$A(1 - \sin\theta) = 2A',$$

$$\frac{\pi d''^2}{4}(1 - \sin\theta) = \frac{2\pi d'^2}{4}, \text{ and}$$

$$\frac{d''}{d'} = \sqrt{\frac{2}{1 - \sin\theta}} \qquad (1).$$

Namely, if the ratio of the diameter led out from the formula (1) corresponding to a half opening angle $\theta$ of the V-shape supporting plate 44 is given to the load receiving piston 45 and the balanced pistons 46, the center of the mold 11 can be automatically placed always at the predetermined position 0 regardless of different diameters.

In FIGS. 6 (A) and 6 (B) showing the concrete condition in the said third embodiment, the balanced pistons 46 and 46 are fixed to the lower side of a base 47 and the balanced pistons 46 and 46 are provided inside the balanced cylinders 42 and 42 which positions are fixed in the freely slidable manner. The inner diameter *d′* of the balanced cylinders 42 and 42 has a relation calculated by the said formula (1) against the inner diameter *d″* of the load receiving cylinder 43. The balanced cylinders 42 and 42 are connected with the load receiving piston 45 through a brance pipe 48 and a flexible pipe 50. A valve 49 is provided at the central upper part of the load receiving piston 45 in the freely slidable manner under the pressure of a spring. When the valve 49 moves inside the load receiving piston 45, the inside of the load receiving cylinder 43 is connected with the flexible pipe 50 by a central hole and a side hole provided at the valve 49. The load receiving piston 45 and the valve 49 inside the load receiving cylinder 43 are projecting at the lower part of the V-shape supporting plate 44 in the freely slidable manner.

In the abovementioned structure, if the mold 11 is placed on the V-shape supporting plate 44 as shown in FIG. 6 (A), the V-shape supporting plate 44 which has been pushed up by restoring springs provided on the balanced pistons 46 and 46 is lowered together with the balanced pistons 46 and 46, and thereby the liquid inside the balanced cylinders 42 and 42 is pushed into the load receiving cylinder 43 through the pipes 48 and 50 and the valve 49. Therefore the load receiving piston 45 is pushed up together with the valve 49 until the top of the valve 49 contacts with the bottom of the mold 11. The valve 49 is pushed down by the mold 11 and closes an opening of the flexible pipe 50 provided at the side wall of the load receiving piston 45, and the lowering movement of the mold 11 is stopped in the condition shown in FIG. 6 (B). The abovementioned movement is carried out regardless of different diameters of the molds 11 and further always the center of the mold 11 is placed at the determined position 0 as described before.

Hereinbefore the three embodiments of the invention have been described. However the present invention is not necessarily limited to the abovementioned three embodiments and various modifications are possible within the scope of the idea of the invention. For example in the third embodiment, the number of the balanced cylinders and the balanced pistons is not limited to two, and one or more than two is also good to attain the object. Moreover the invention has been described about a cylindrical mold for a concrete pile and the like for convenience' sake, however this invention is applicable widely as an apparatus for automatically adjusting the center-height of various shapes of substances like a taper-cylindrical mold for a concrete pole and the like.

We claim:

1. An apparatus for automatically adjusting the height of a mold relative to a platform comprising:

lift means positioned below said mold for supporting said mold and moving said mold vertically;

control means for controlling the vertical movement of said lift means;

a first sensor on said platform for sensing the presence of a mold on said lift means and thereby activating said control means;

a second sensor on said platform for sensing the vertical position of said mold and thereby deactivating said control means;

said second sensor comprising a support mounted to said platform, a first and second lever pivotally mounted to said support so that the angle formed by the longitudinal axis of said first and second levers is bisected by a line between the center of the mold in its final position and the apex of the angle formed by said first and second levers, a pair of intermeshing gears mounted respectively to the pivotal connection of said levers to said support for synchronizing angular movement of said first and second levers and a switch on the other end of said second lever to sense the presence of the mold at a preselected center distance and deactivate said control means.

2. The apparatus of claim 1 wherein said lift means includes a pair of supports mounted to said platform, a lifting device centered between said pair of supports, a pair of arms, each pinned at one end to one of said pair of supports and at their other end to said lifting device so that the angle formed by said pair of arms varies with the vertical movement of said lifting device.

3. The apparatus of claim 2 wherein said said control means is a motor for driving said lifting device and said first sensor is a load cell responsive to the weight of said mold on said platform.

4. The apparatus of claim 1 including a third sensor, identical to said second sensor along the longitudinal axis of said mold, the first levers of said second and third sensors are connected at their other ends by a rod which comes in contact with said mold.

5. The apparatus of claim 1 including a spring connected between said first and second levers pulling said levers together.

* * * * *